US008757850B2

(12) United States Patent
Beghelli

(10) Patent No.: US 8,757,850 B2
(45) Date of Patent: Jun. 24, 2014

(54) LIGHTING FIXTURE WITH CONTROLLED PHOTOMETRIC LIGHT EMISSION

(75) Inventor: Gian Pietro Beghelli, Monteveglio (IT)

(73) Assignee: Beghelli S.p.A., Monteveglio (Bologna) (IT)

( * ) Notice: Subject to any disclaimer, the term of this patent is extended or adjusted under 35 U.S.C. 154(b) by 176 days.

(21) Appl. No.: 13/398,536

(22) Filed: Feb. 16, 2012

(65) Prior Publication Data

US 2012/0224369 A1 Sep. 6, 2012

(30) Foreign Application Priority Data

Mar. 2, 2011 (IT) ..... VI2011A0038

(51) Int. Cl.

| | |
|---|---|
| ***F21V 5/04*** | (2006.01) |
| ***F21V 3/02*** | (2006.01) |
| ***F21V 21/00*** | (2006.01) |
| ***F21V 17/06*** | (2006.01) |

(52) U.S. Cl.

USPC ..... 362/335; 362/311.02; 362/311.06; 362/368; 362/375; 362/455

(58) Field of Classification Search

USPC ..... 362/294, 335, 336, 311.02, 311.06, 362/311.1, 368, 373, 375, 455

See application file for complete search history.

(56) References Cited

U.S. PATENT DOCUMENTS

| | | | | |
|---|---|---|---|---|
| 6,461,024 | B1 * | 10/2002 | Becker et al. | 362/331 |
| 7,226,185 | B2 * | 6/2007 | Dolgin et al. | 362/239 |
| 7,810,951 | B1 * | 10/2010 | Lee et al. | 362/249.03 |
| 7,857,497 | B2 * | 12/2010 | Koike et al. | 362/545 |
| 7,942,559 | B2 * | 5/2011 | Holder et al. | 362/311.06 |
| 8,226,276 | B2 * | 7/2012 | Pachler et al. | 362/311.02 |
| 8,434,914 | B2 * | 5/2013 | Li et al. | 362/335 |
| 8,456,768 | B2 * | 6/2013 | Shih et al. | 359/819 |
| 2009/0225543 | A1 * | 9/2009 | Jacobson et al. | 362/247 |
| 2010/0284182 | A1 * | 11/2010 | Pan | 362/235 |

* cited by examiner

*Primary Examiner* — Alan Cariaso

(74) *Attorney, Agent, or Firm* — Hedman & Costigan, P.C.; James V. Costigan; Kathleen A. Costigan

(57) ABSTRACT

Lighting fixture (10) with controlled photometric light emission, comprising a LED light source (21), whose operation is ensured by an electronic printed circuit board (20) which is properly sized and designed, and a housing (30) for containing the LED light source (21) and the electronic printed circuit board (20), able to obtain a heat dissipation; in particular, different type of lenses (25, 26, 27) having different surface geometry can be placed over the LED light source (21), said lenses (25, 26, 27) being able to direct the light beam emitted from the LED light source (21), in order to obtain uniform illumination on surfaces having variable geometry.

4 Claims, 13 Drawing Sheets

LIGHTING FIXTURE WITH CONTROLLED PHOTOMETRIC LIGHT EMISSION

The present invention generally relates to a lighting fixture with controlled photometric emission, which can be installed in residential and/or industrial environments.

More particularly, the invention relates to a lighting fixture and, specifically, for the emergency lighting that uses LED light sources, whose photometric emission (i.e. the distribution of light intensity outputting from the LED light source) is modified, with respect to the prior art, through the use of additional lenses.

The lighting fixtures as well as apparatus for emergency lighting have several photometric emission characteristics, which depend on their actual usage.

For example, in special applications, such as, for example, emergency lights facilities installed in rooms used for public performances, luminaires with different types of light sources are used and, typically, some of said light sources are incandescent-type lights while some of them are fluorescent-type lights.

In normal operating conditions, i.e. when a power supply is connected, the low-power incandescent lamps are switched on, so as to provide a low luminous intensity and illuminate the signs stating the exits (the escape routes) from a room, without causing discomfort to the eyes of the viewers, and, when the power supply is interrupted, automatically the fluorescent lamps turn on, so as to provide the luminous intensity required to illuminate the emergency exits.

On the other hand, however, in industrial environments there is the need to effectively deliver, during emergency conditions (such as lack of power supply, danger or fire principles), a beam of light with high luminous intensity and concentrated in substantially rectangular areas, such as the workplace, the escape routes and/or the high-risk areas, where hazardous activities take place or areas in which the safety of persons depends on skilled workers.

In any case, there is a need to provide lighting fixtures, in particular emergency lighting fixtures, which can be used for the main types of electric installation and which are able to achieve a uniform illumination of rectangular areas, or which can be used only where it is necessary to ensure the presence of the emergency lighting.

The purpose of the present invention is therefore to indicate a lighting fixture with controlled photometric emission, which is suitable for the main types of installation and that achieves a high illumination only in prefixed areas or in areas of substantially rectangular shape, such as the high-risk areas, and that allows for a anti-panic lighting in industrial environments and/or along the escape routes, in emergency conditions.

Another purpose of the present invention is to indicate a lighting fixture with controlled photometric emission, which obtains a substantially uniform lighting on substantially rectangular or square surfaces.

A further purpose of the invention is to indicate a lighting fixture with controlled photometric emission of easy and inexpensive construction, without the use of complex and/or expensive technologies.

These and other purposes are achieved by a lighting fixture with controlled photometric emission controlled according to the attached claim 1.

Advantageously, the device according to the invention allows to obtain, at the same time, uniform lighting on the ground, so as to satisfy the national and international regulations on safety in civil and/or industrial environments, and suitable technical features in order to carry out emergency functions.

The uniform lighting is achieved on surfaces which substantially rectangular or square, especially by using a light source, such as a power LED, an electronic device for feeding the light source and one or more lenses that appropriately address the light beam.

The most common installations of the emergency lighting fixture, which is the object of the present invention, include built-in installations, installations on existing lighting installations, ceiling installations (at 3 or 7 meters in height) and wall installations.

Further purposes and advantages of the present invention will be clear from the description that follows, which refers to different and preferred, but not limited, embodiments of the lighting fixture which is the object of the present invention, and from the attached drawings, in which.

Figure 1:
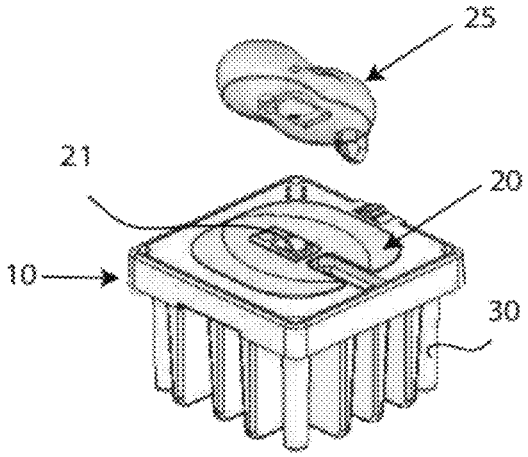
FIGS. 1, 2 and 3 represent exploded perspective views of three different embodiments of the lighting fixture with controlled photometric emission according to the present invention.
Figure 2:
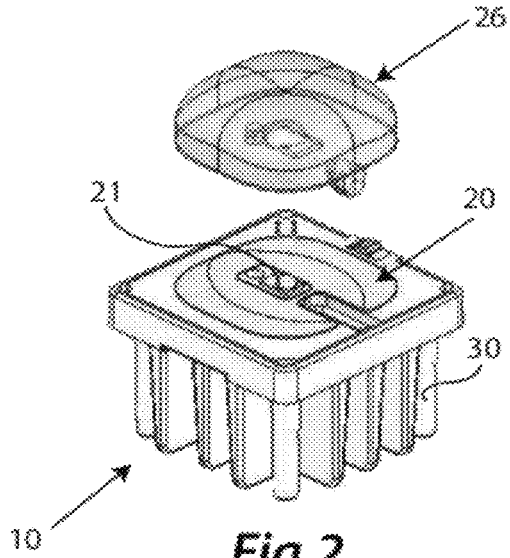
Figure 3:
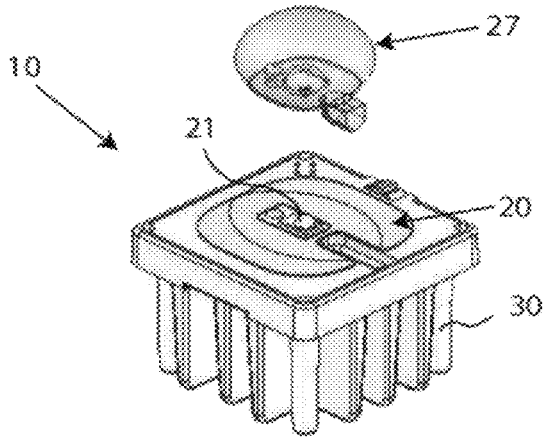
Figure 4:
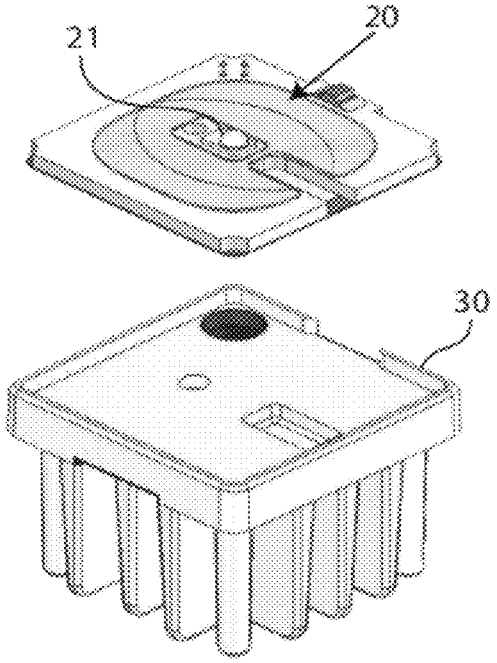
FIG. 4 is an exploded perspective view of part of the lighting fixture with controlled photometric emission according to the present invention.
Figure 5:
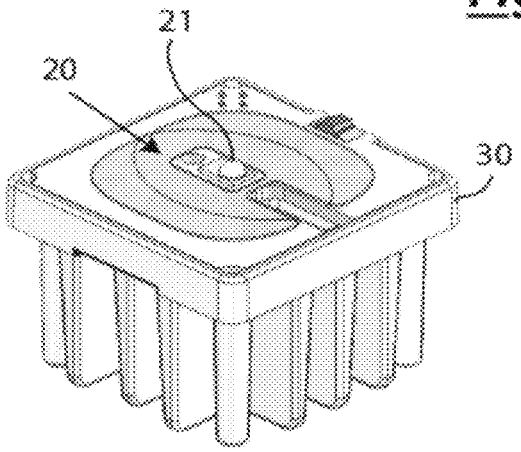
FIG. 5 is a top perspective view of the part of the lighting fixture shown in FIG. 4, according to the present invention.
Figure 6:
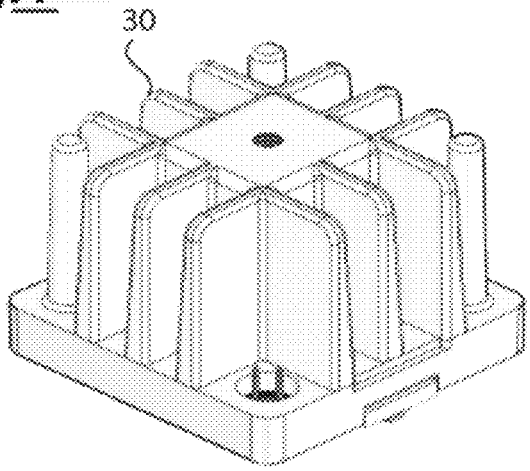
FIG. 6 is a bottom perspective view of the part of the lighting fixture shown in FIG. 4, according to the present invention.

With particular reference to the attached FIGS. 1 to 6, which refer to the lighting fixture 10 of the invention, a printed circuit board properly sized and designed to ensure optimum operation of the light source (which is preferably constituted by a power LED 21) is indicated with 20, while a containment case, made preferably of aluminum, which also realizes the function of a heat sink unit of the fixture 10, is indicated with 30, while three different types of shaped lenses (made of methacrylate (PMMA) with high transparency) are generally indicated with 25, 26, 27 and are placed above the power LED 21, so as to direct appropriately the light beam going out the LED source 21 and to obtain a substantially uniform luminance on substantially rectangular and/or square surfaces.

The lighting fixture 10 is used, with suitable adapters, for different types of products and installations used for emergency lighting devices, such as built-in installations, installations on existing lighting bodies, ceiling installations and/or wall installations.

In particular, for built-in installations (FIG. 7, 8, 9), it is possible to provide installations of the lighting fixture 10 according to which the fixture 10 is fixed, through a bracket 24, to a ceiling at 7 meters from the floor and has lens 27 which are placed inside a cover body 23 made of polycarbonate (with protection IP42) and which are shaped according to a so-called "Altaluce" installation.

Figure 7:
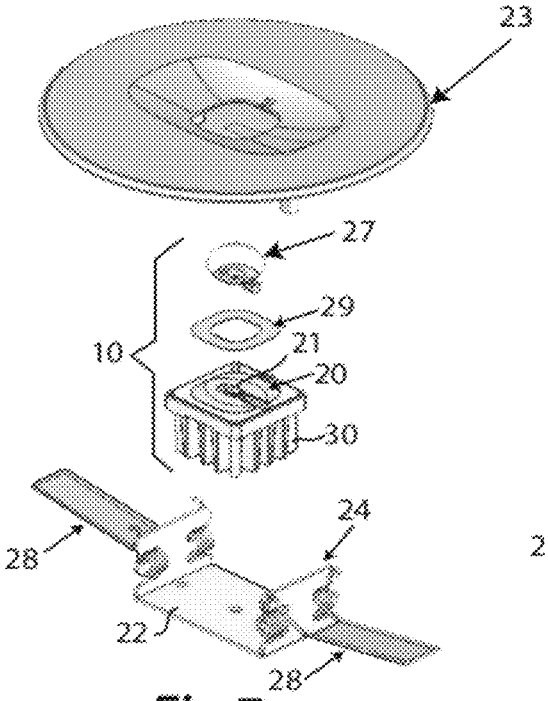
FIGS. 7, 8 and 9 show exploded perspective views of the embodiments of the lighting fixture, according to the invention, illustrated in FIGS. 1, 2 and 3, respectively, in case of built-in and ceiling installations.

Said type of installation, which also has a protective film 29 placed between the cover body 23 and the printed circuit board 20, is able to generate a symmetrical distribution of light, so that the illuminated area on the floor has a square shape (FIG. 7).

Figure 8:
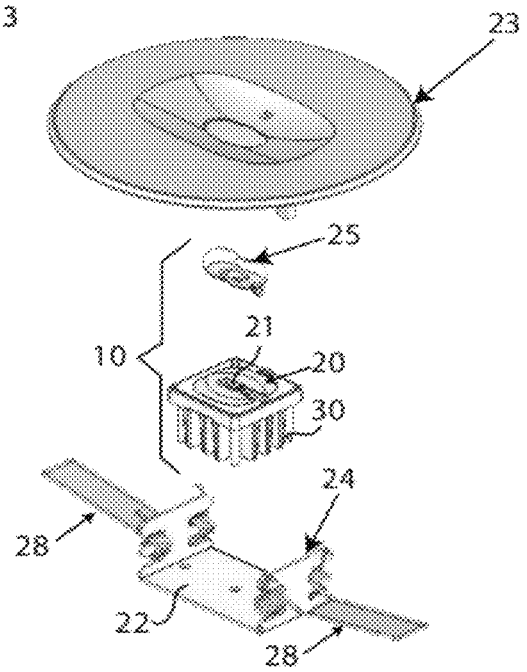
Figure 9:
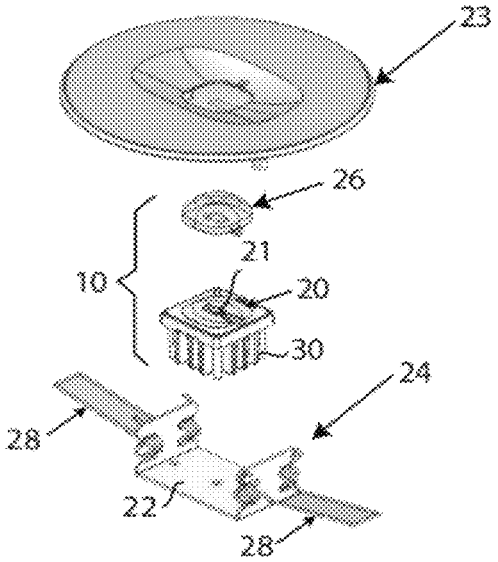

Alternatively, it is possible to provide installations of the lighting fixture 10 which is fixed to a ceiling at 3 meters from the floor and equipped with so-called "Lungaluce" lenses 25, which generate an asymmetric distribution of light, so that the illuminated area on the floor has a rectangular shape (FIG. 8), and/or installations of the fixture 10 at 3 meters from the floor with so-called "Largaluce" lenses 26, which generate a symmetrical distribution of light, so that the illuminated area on the floor has a square shape (FIG. 9).

In these configurations, the lighting fixture 10 is mounted on the metal frame 22 of the bracket 24 and the metal frame 22 is used, together with a pair of springs 28, to secure the polycarbonate body 23 against panels of plaster ceilings, while the cover body 23 can be made according to two different geometric types, one of them which is used for the two versions with symmetrical distribution of light and the other which is used for the version with asymmetric distribution of light.

Figure 10:
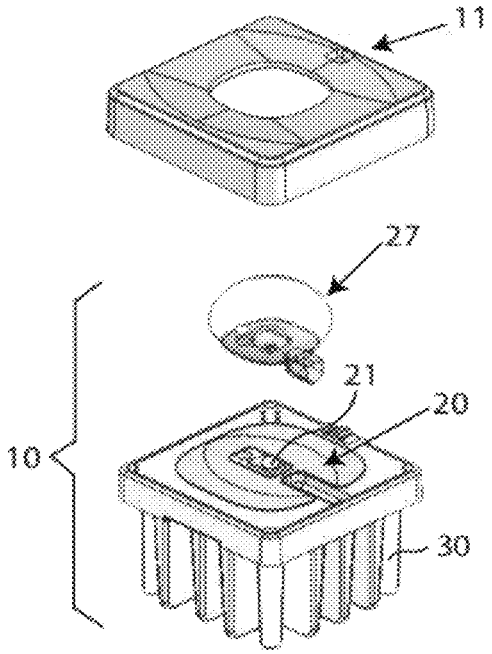
FIGS. 10, 11 and 12 show exploded perspective views of the embodiments of the lighting fixture, according to the invention, illustrated in FIGS. 1, 2 and 3, respectively, in case of existing lighting installations and ceiling installations.
Figure 11:
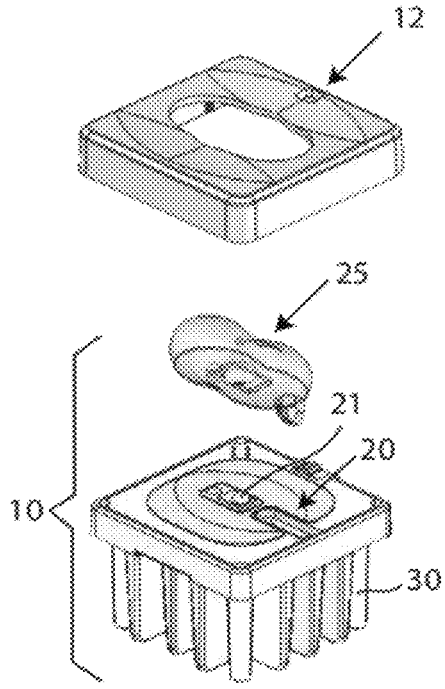
Figure 12:
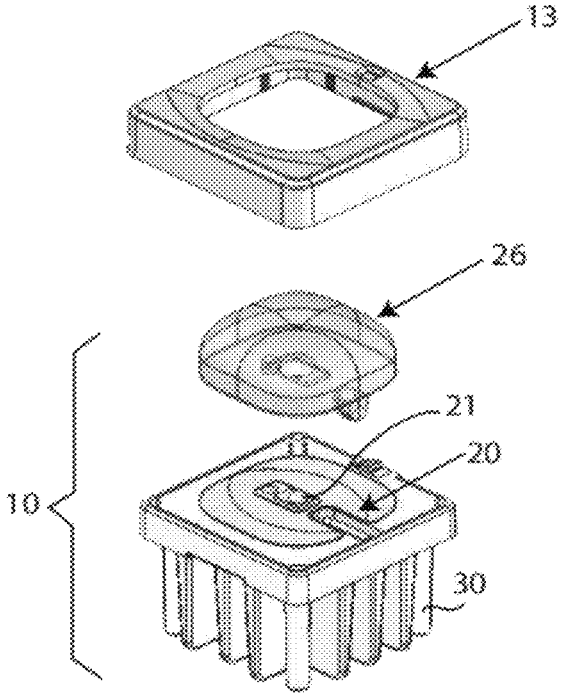

The enclosed FIGS. 10, 11 and 12 show a series of typical installations of the lighting fixture 10 which are similar to those described in the respective FIGS. 7, 8 and 9 and which can be made on existing lighting fixtures; in this case, three cover bodies or protective covers 11, 12, 13 are used, said covers are geometrically different between them and the lighting fixture 10 is used in general existing lighting products so as to integrate within them the function relating to the emergency lighting.

Figure 13:
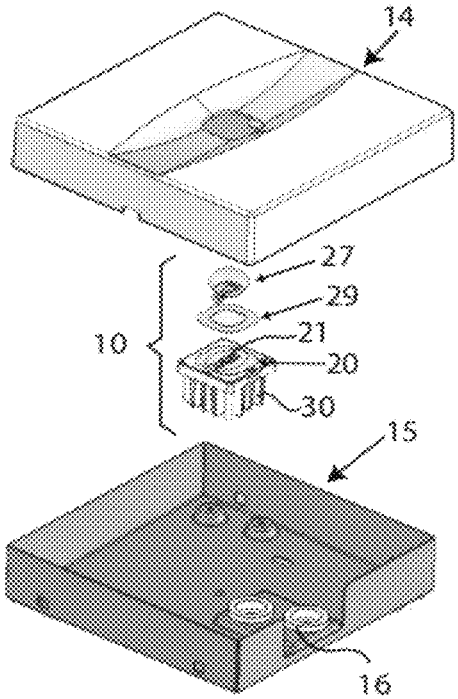
FIGS. 13 and 14 show two exploded perspective views of a lighting fixture with controlled photometric emission, according to the invention, with symmetrical light distribution and with high ceiling and/or wall installations.
Figure 14:
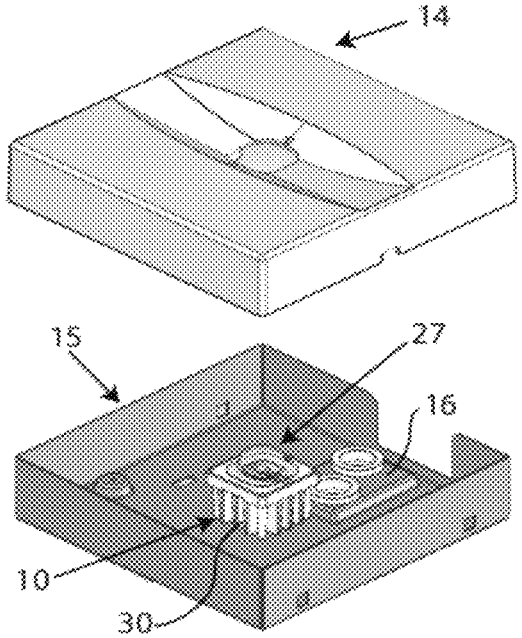
Figure 15:
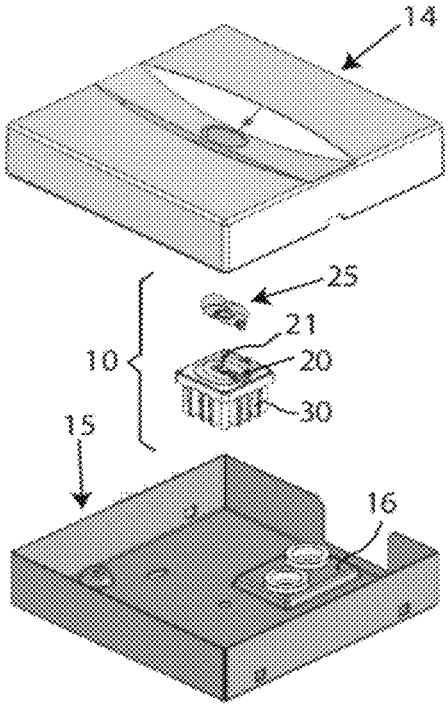
FIGS. 15 and 16 show two exploded perspective views of a lighting fixture with controlled photometric emission, according to the invention, with asymmetric light distribution, with low ceiling and/or wall installations.
Figure 16:
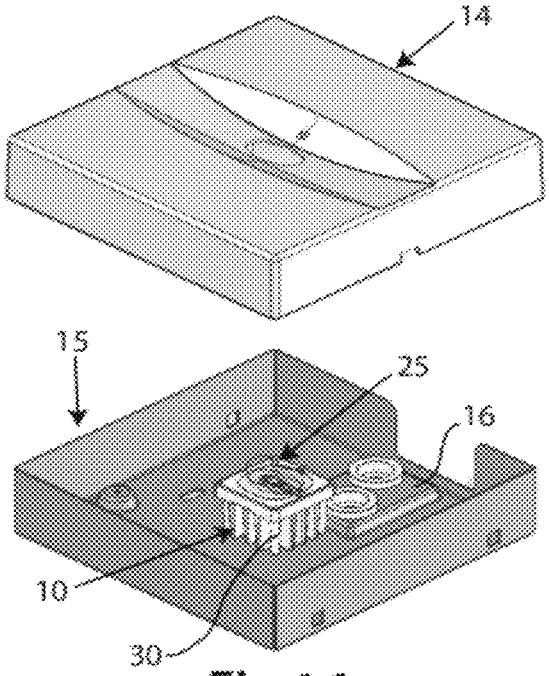
Figure 17:
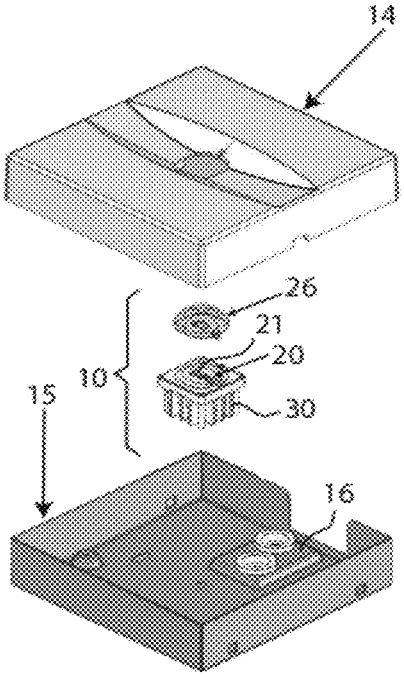
FIGS. 17 and 18 show two exploded perspective views of a lighting fixture with controlled photometric emission, according to the invention, with symmetrical light distribution, with low ceiling and/or wall installations.
Figure 18:
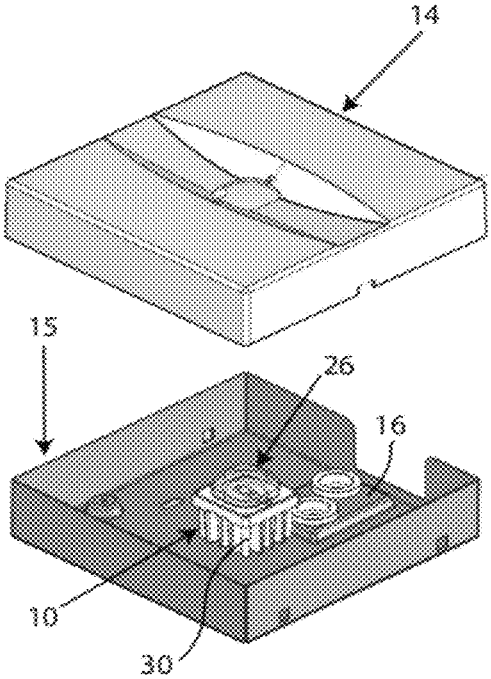

For ceiling and/or wall installations, it is possible to provide, in a similar way to what has been described above, installations of the lighting fixture 10 at 7 meters from the floor, with a symmetrical distribution of light and a squared area which is illuminated at floor (FIG. 13, 14), installations of the lighting fixture 10 at 3 meters from the floor, with an asymmetric distribution of light and a rectangular area which is illuminated at floor (FIG. 15, 16), and installations of the lighting fixture 10 at 3 meters from the floor with a symmetrical distribution of light and a squared area which is illuminated at floor (FIG. 17, 18).

In the latter case, the lens 26 may have an outer satin surface.

In the above configurations, the lighting fixture 10 is mounted inside a metal box 15, where there are the power supply electronic devices 16, while the cover body 23 can be made in two different geometric types, one of them used for the two versions with symmetrical distribution of light and the other used for the version with asymmetric distribution of light.

Figure 19:
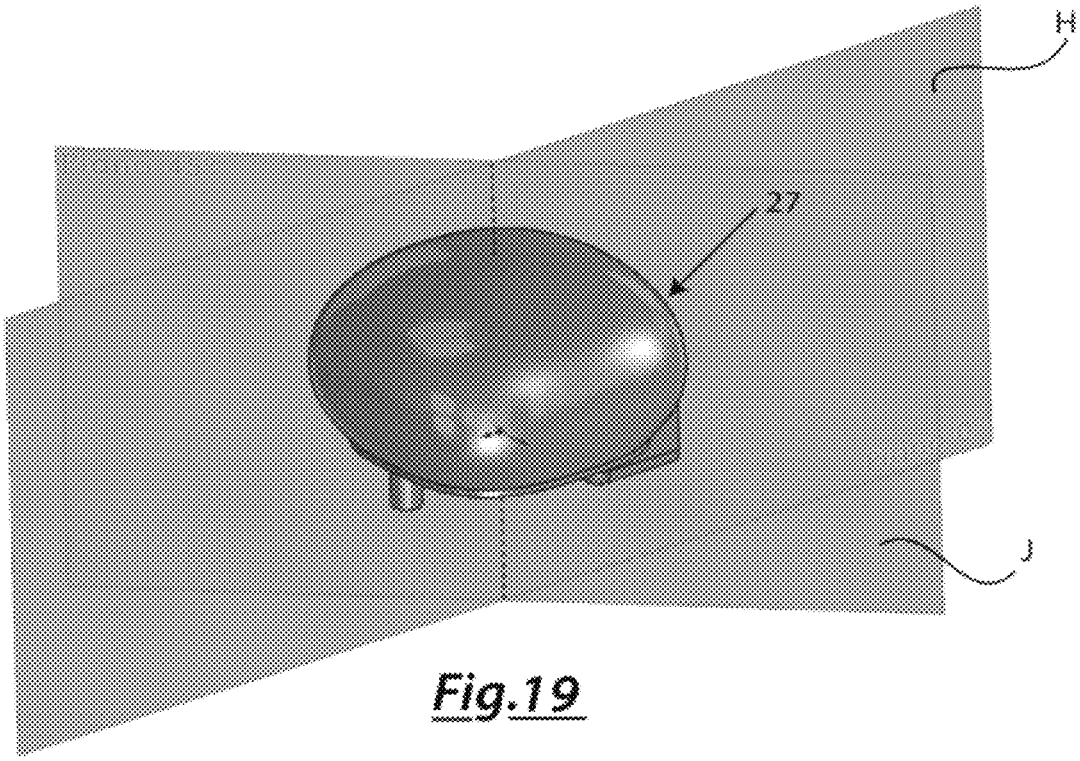
FIG. 19 shows a perspective view of a first lens used in the lighting fixture with controlled photometric emission according to the invention.

In particular, the so-called "Altaluce"-type lens 27 (which is shown in detail in the enclosed FIG. 19) is designed so as to produce a uniform illumination in a squared area using a methacrylate (PMMA) and a white power LED 21 as a light source.

According to this application, the illuminated surface (equal to 12.5 m×12.5 m) satisfies the national and international rules of anti-panic (UNI EN 1838) for installations of the lighting fixture 10 at 7 meters from the floor.

Figure 20:
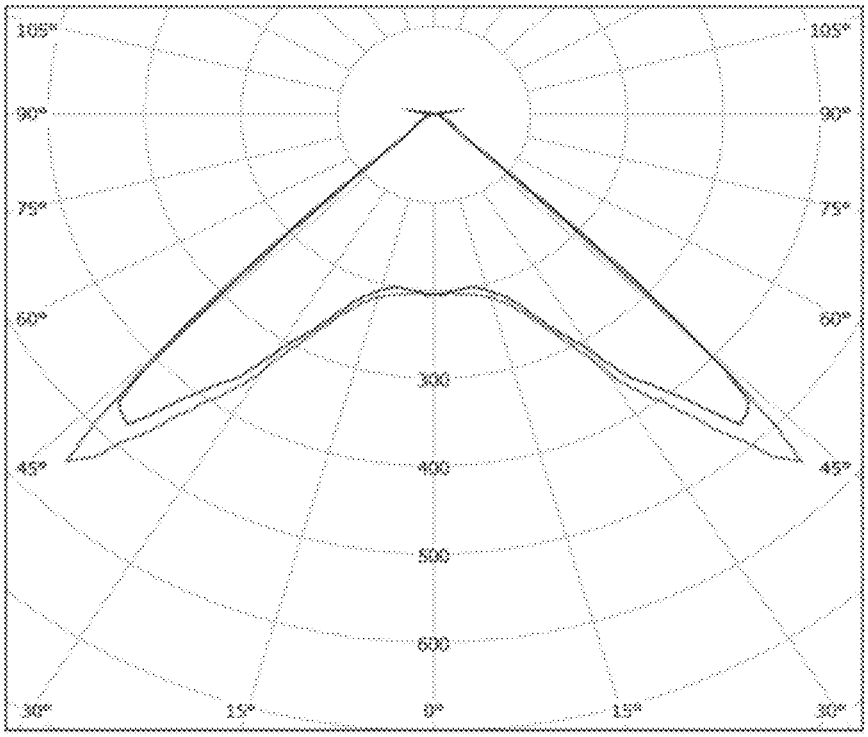
FIG. 20 shows a graph of the luminous intensity produced by the lens shown in FIG. 19.
Figure 21:
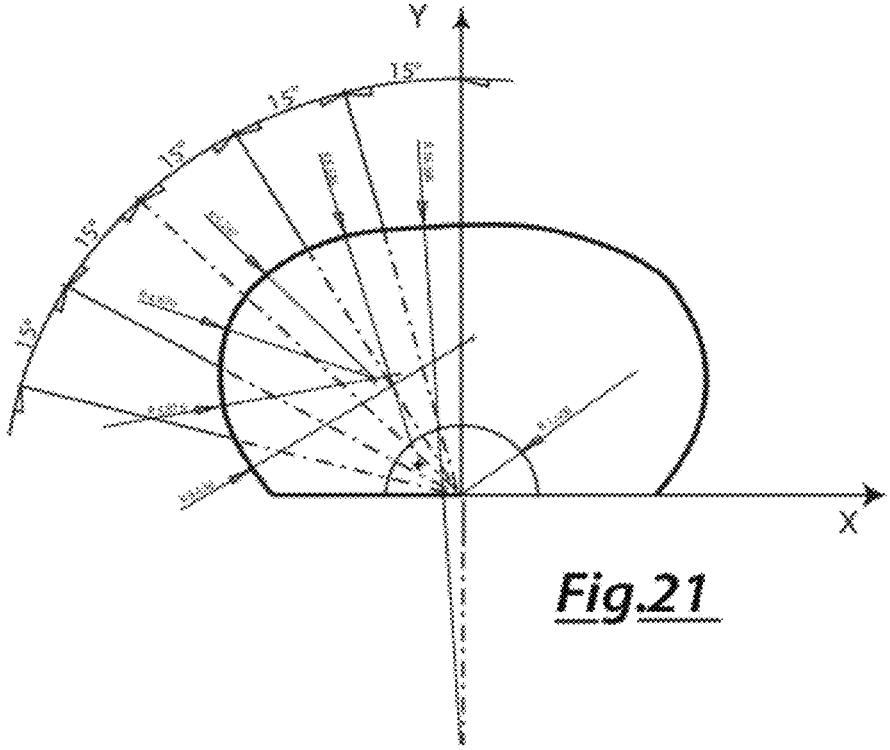
FIGS. 21 and 22 show two cross sections of the lens shown in FIG. 19, where the axes of the section plane axes are indicated, as well as the radii and the centers of the arcs making the cross section profiles are indicated.
Figure 22:
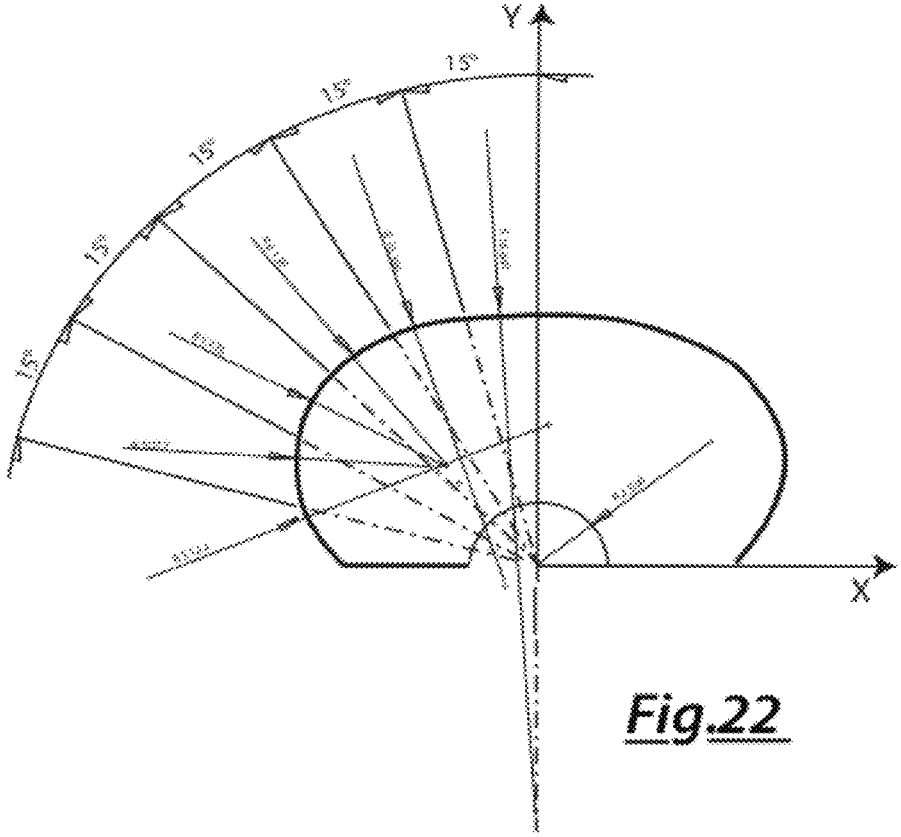

The graph of the radiant intensity is shown in the enclosed FIG. 20, while FIGS. 21 and 22 show, respectively, the cross section of the lens 27 in the H-plane (at 0°), which is the same as the cross section of the lens 27 in a plane at 90°, and the cross section in the plane J (at 45°), with the X and Y axes of the cross section plane, as well as the radii and the centers of the arcs of the lens 27 profile, according to the following summary tables:

1) CROSS SECTION PLANE H (0° AND 90°)

| ARC (°) | PROFILE RADIUS (mm) | POSITION X-AXIS (mm) | POSITION Y-AXIS (mm) |
|---|---|---|---|
| 0°-15° | 18.596 | −0.107 | −8.865 |
| 15°-30° | 8.549 | −1.434 | 1.093 |
| 30°-45° | 5.267 | −2.839 | 4.060 |
| 45°-60° | 4.670 | −3.325 | 4.407 |
| 60°-75° | 5.916 | −2.080 | 4.352 |
| 75°-90° | 8.636 | 0.324 | 5.641 |

2) CROSS SECTION PLANE J (45°)

| ARC (°) | PROFILE RADIUS (mm) | POSITION X-AXIS (mm) | POSITION Y-AXIS (mm) |
|---|---|---|---|
| 0°-15° | 18.640 | −0.167 | −8.909 |
| 15°-30° | 10.396 | −1.228 | −0.734 |
| 30°-45° | 6.138 | −2.829 | 3.212 |
| 45°-60° | 5.223 | −3.504 | 3.829 |
| 60°-75° | 5.077 | −3.647 | 3.861 |
| 75°-90° | 5.124 | −3.602 | 3.876 |

Figure 23:
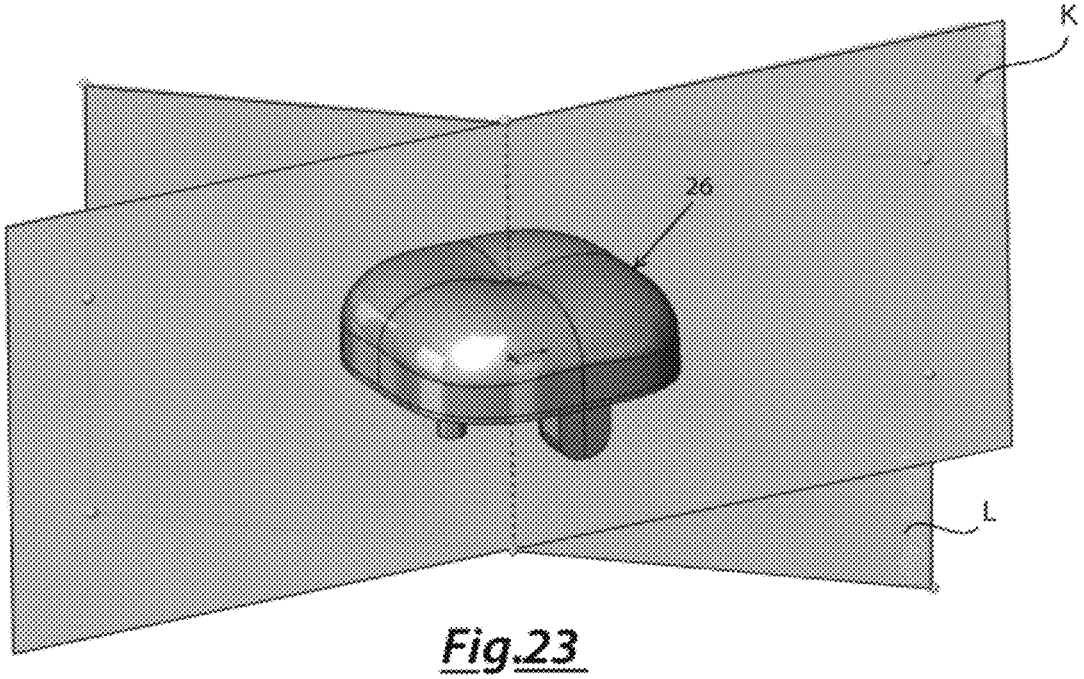
FIG. 23 shows a perspective view of a second lens used in the lighting fixture with controlled photometric emission according to the invention.

Moreover, the so-called "Largaluce"-type lens 26 (shown in detail in the enclosed FIG. 23) is designed to produce uniform lighting on a squared surface using a methacrylate (PMMA) and a white power LED 21 as a light source.

According to this application, the illuminated surface (equal to 11.5 m×11.5 m) satisfies the national and international rules of anti-panic (UNI EN 1838) for installation of the lighting fixture at 3 meters from the floor.

Figure 24:
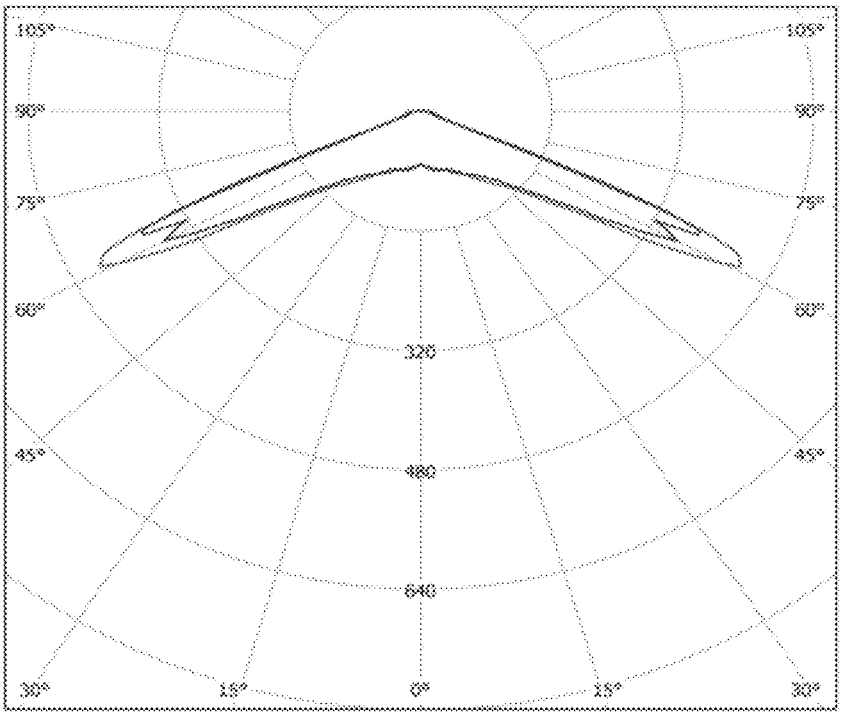
FIG. 24 shows a graph of the radiating intensity produced by the lens of FIG. 23.
Figure 25:
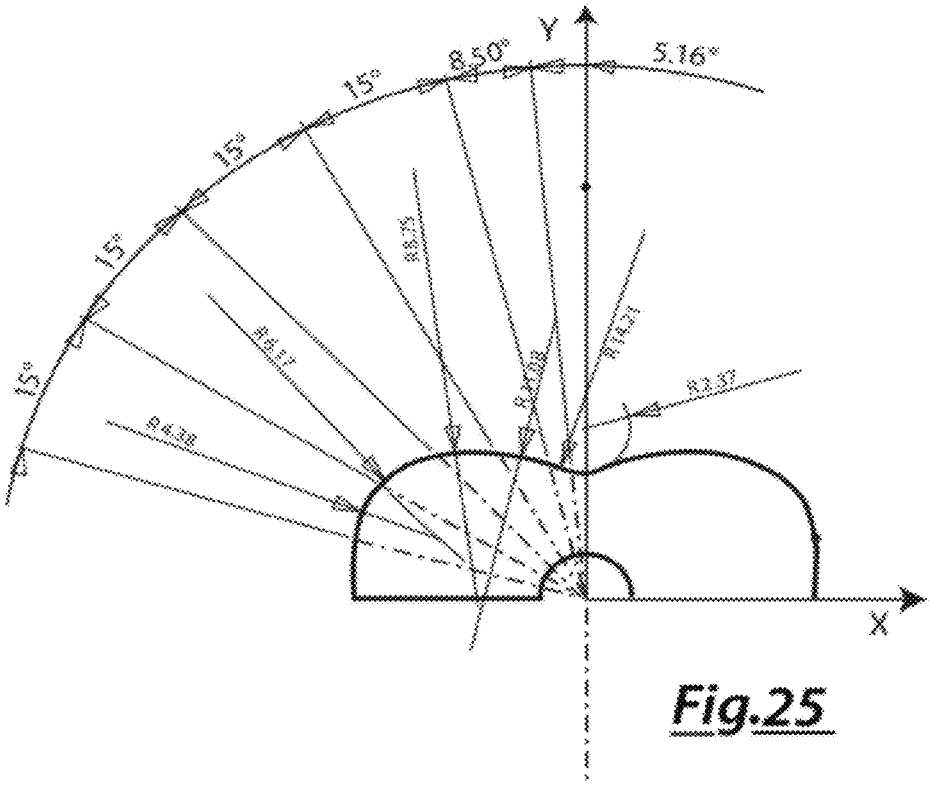
FIGS. 25 and 26 show two cross sections of the lens shown in FIG. 23, where the axes of the section plane are indicated, as well as the radii and the centers of the arcs making the cross section profiles are indicated.
Figure 26:
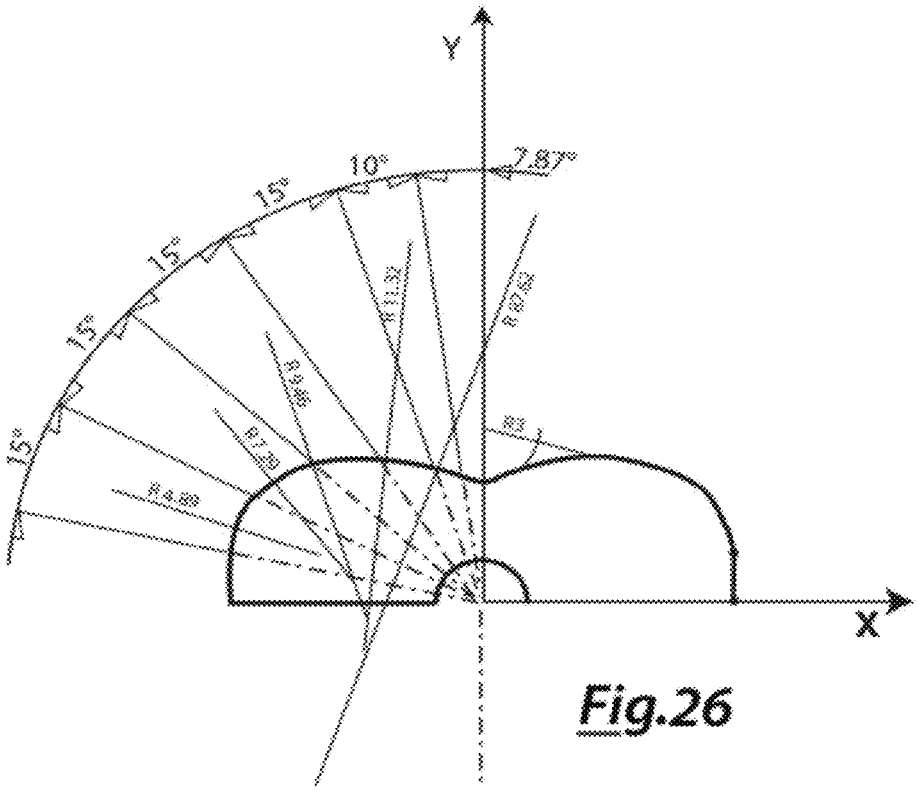

The graph of the radiant intensity is shown in the enclosed FIG. 24 (for two types of lenses 26), while FIGS. 25 and 26 show, respectively, the cross sections of the lens 26 in the K-plane (at 0°; said plane has a cross section equal to the cross section in a plane at 90°), and in the L-plane (at 45°), as well as the X and Y axes of the cross section plane and the radii and the centers of the arcs of the lens 26 profile, according to the following summary tables:

1) CROSS SECTION PLANE K (0° AND 90°)

| ARC (°) | PROFILE RADIUS (mm) | POSITION X-AXIS (mm) | POSITION Y-AXIS (mm) |
|---|---|---|---|
| 0°-15° | 2.37 | −0.06 | 9.49 |
| 15°-30° | 14.21 | −3.09 | 20.92 |
| 30°-45° | 11.08 | −5.69 | −2.80 |
| 45°-60° | 8.75 | −5.44 | −0.48 |
| 60°-75° | 6.17 | −6.08 | 2.01 |
| 75°-90° | 4.38 | −7.36 | 3.28 |

2) CROSS SECTION PLANE L (45°)

| ARC (°) | PROFILE RADIUS (mm) | POSITION X-AXIS (mm) | POSITION Y-AXIS (mm) |
|---|---|---|---|
| 0°-15° | 3.00 | 0.04 | 10.12 |
| 15°-30° | 87.62 | −31.61 | −74.79 |
| 30°-45° | 11.32 | −6.29 | −2.82 |
| 45°-60° | 9.46 | −6.16 | −0.96 |
| 60°-75° | 7.29 | −6.80 | 1.11 |
| 75°-90° | 4.89 | −8.53 | 2.78 |

Figure 27:
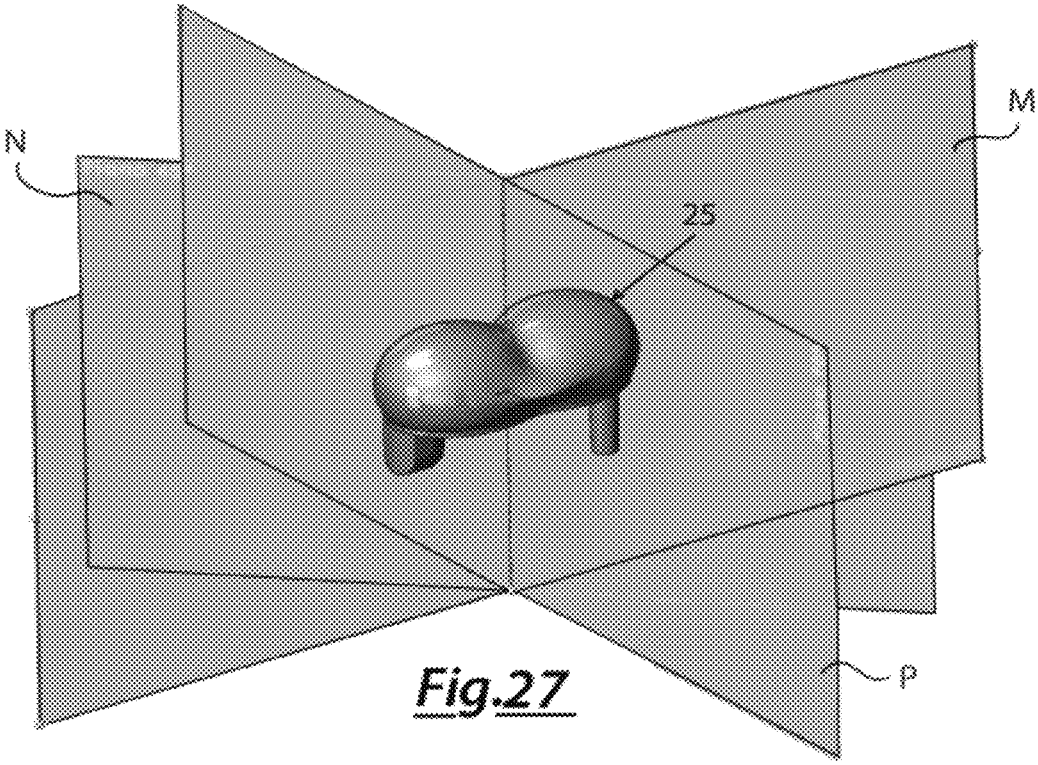
FIG. 27 shows a perspective view of a third lens used in the lighting fixture with controlled photometric emission according to the invention.

Finally, the so-called "Lungaluce" type lens 25 (which is shown in detail in the enclosed FIG. 27) is designed to produce a uniform illumination of a rectangular surface using methacrylate (PMMA) and a white power LED 21 as a light source.

According to this application, the illuminated surface (which has to be 17 meter length with a light source at 3 meters from the floor, according to the national and international rules of emergency lighting) satisfies the rules for emergency escape routes which are 2 meters wide (according to the UNI EN 1838 rule) for installations of the lighting fixture 10 at 3 meters from the floor.

Figure 28:
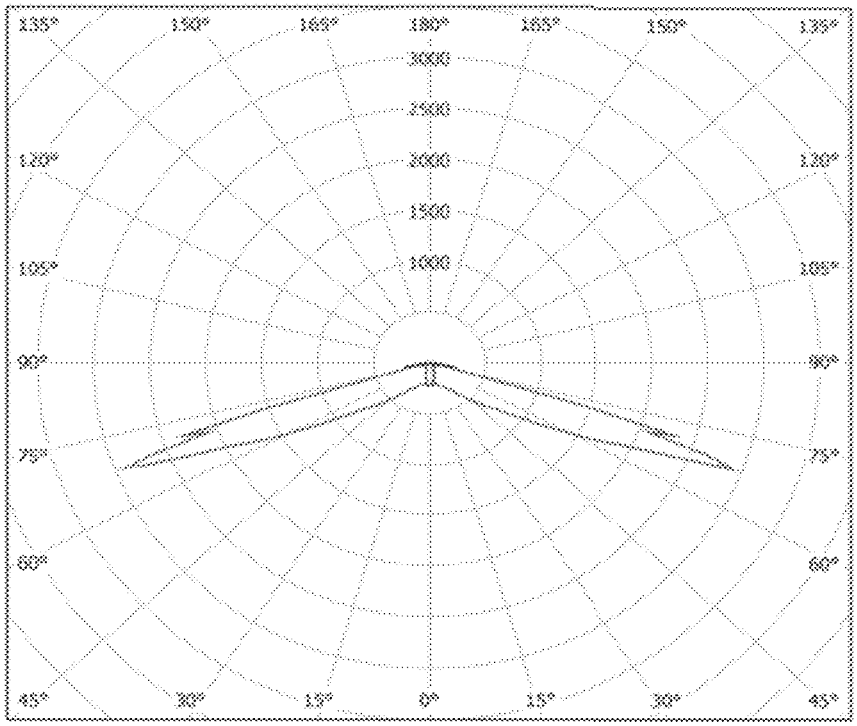
FIG. 28 shows a graph of the radiating intensity produced by the lens shown in FIG. 27.
Figure 29:
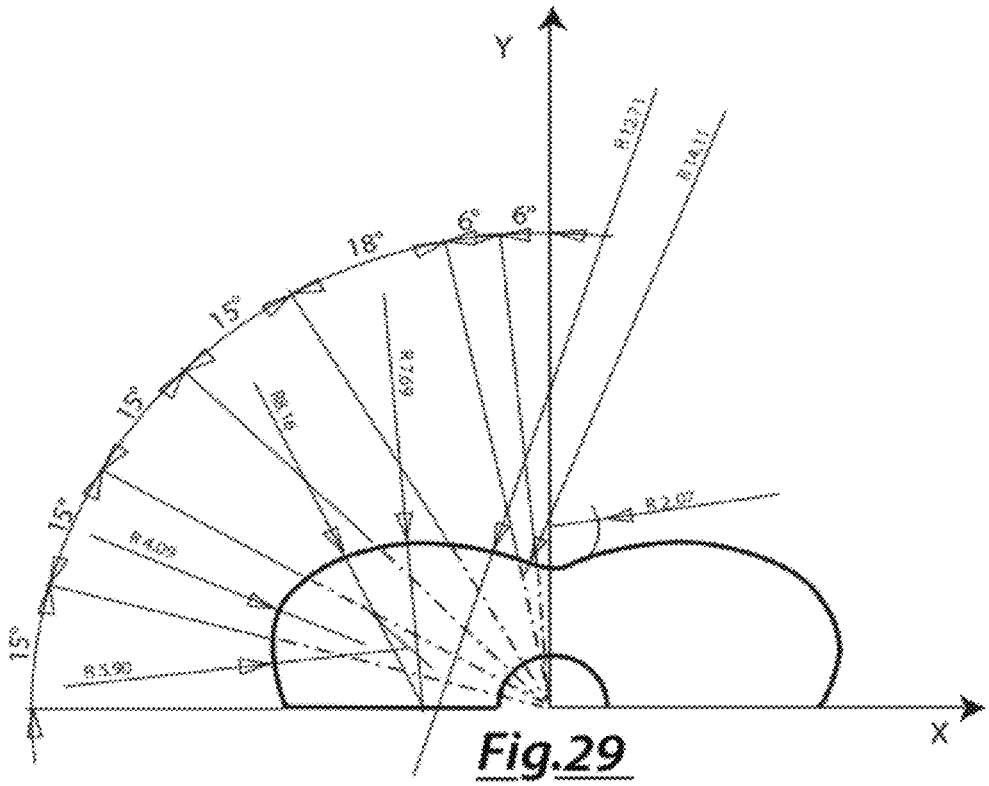
FIGS. 29, 30 and 31 show three cross sections of the lens shown in FIG. 27, where the axes of the section plane are indicated, as well as the radii and the centers of the arcs making the cross section profiles are indicated.
Figure 30:
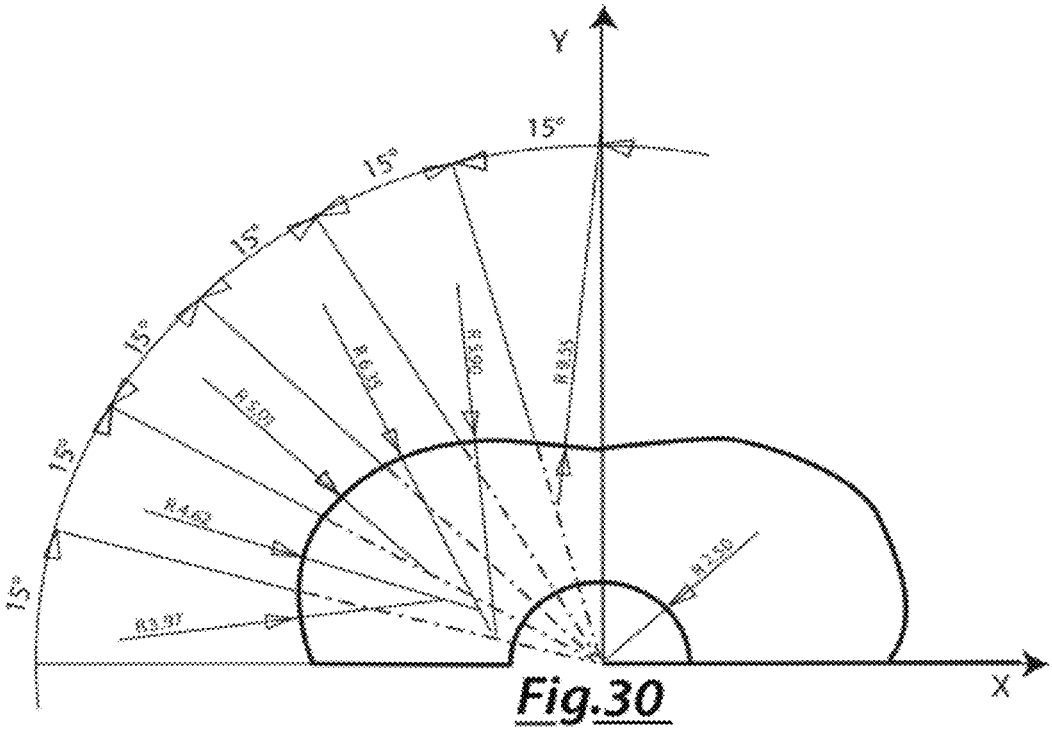
Figure 31:
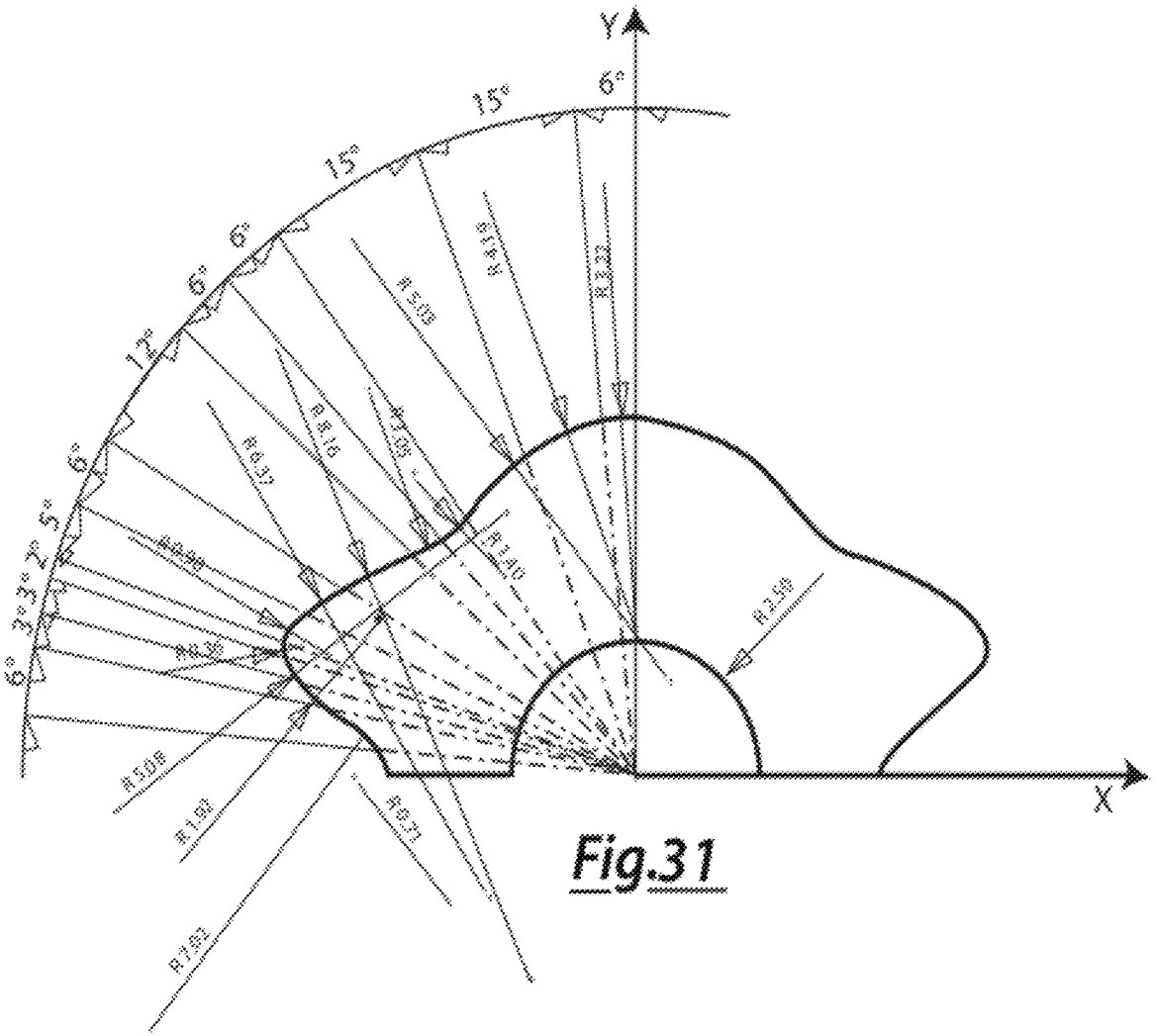

The graph of the radiant intensity is shown in the enclosed FIG. 28, while FIGS. 29, 30 and 31 show, respectively, a cross section of the lens 25 in the plane M (at 0°), a cross section of the lens 25 in the plane N (at 45°) and a cross section of the lens 25 in the plane P (at 90°), as well as the X and Y axes of the section plane and the radii and the centers of the arcs forming the lens 25 profile, according to the following summary tables:

1) SECTION PLANE M (0°)

| ARC (°) | PROFILE RADIUS (mm) | POSITION X-AXIS (mm) | POSITION Y-AXIS (mm) |
|---|---|---|---|
| 0°-6° | 2.07 | 0.00 | 8.60 |
| 6°-12° | 14.11 | 4.08 | 19.93 |
| 12°-30° | 12.71 | −6.49 | −4.73 |
| 30°-45° | 7.69 | −5.71 | 0.24 |
| 45°-60° | 8.16 | −5.59 | −0.22 |
| 60°-75° | 4.09 | −8.12 | 2.96 |
| 75°-90° | 5.90 | −6.32 | 2.83 |

2) SECTION PLANE N (45°)

| ARC (°) | PROFILE RADIUS (mm) | POSITION X-AXIS (mm) | POSITION Y-AXIS (mm) |
|---|---|---|---|
| 0°-15° | 9.55 | −0.01 | 16.08 |
| 15°-30° | 5.90 | −2.90 | 0.90 |
| 30°-45° | 6.35 | −2.83 | 0.46 |
| 45°-60° | 5.01 | −3.49 | 1.26 |
| 60°-75° | 4.62 | −3.81 | 1.84 |
| 75°-90° | 3.97 | −4.46 | 1.90 |

3) SECTION PLANE P (90°)

| ARC (°) | PROFILE RADIUS (mm) | POSITION X-AXIS (mm) | POSITION Y-AXIS (mm) |
|---|---|---|---|
| 0°-6° | 3.22 | 0.00 | 3.31 |
| 6°-21° | 4.19 | 0.20 | 2.36 |
| 21°-36° | 5.03 | 0.68 | 1.67 |
| 36°-42° | 1.40 | −4.51 | 5.48 |
| 42°-48° | 3.05 | −5.31 | 6.92 |
| 48°-60° | 8.16 | −2.11 | −3.82 |
| 60°-66° | 6.37 | −2.94 | −2.24 |
| 66°-71° | 0.98 | −6.06 | 2.15 |
| 71°-73° | 0.36 | −6.66 | 2.32 |
| 73°-76° | 5.08 | −2.61 | 4.75 |
| 76°-79° | 1.92 | −5.12 | 2.82 |
| 79°-85° | 7.02 | −9.81 | −4.79 |
| 85°-90° | 0.71 | −5.60 | −0.08 |

Using each of the lenses 25, 26 and 27 (as an alternative to each other), with a geometric profile as detailed above, in order to direct appropriately the light beam, it is possible to made an emergency lighting device which is suitable for the main installation apparatus and which allows to obtain a uniform illumination on rectangular or square surfaces. In these cases the lens surfaces 25, 26 and 27 have a glossy surface, while in case the "Largaluce" lens 26 is used and if the lens 26 is made with a satin surface (a so-called "Diffusaluce" lens), said lens 26 is also suitable for wall installations.

From the above description the features, as well as the advantages, of the lighting fixture with photometric controlled emission, which is the object of the invention, are extremely clear.

In particular, said advantages are:

- flexibility, simplicity and speed of installation and wiring of the fixture;
- compliance with national and international standards in terms of safety in industrial environments;
- more illumination on the ground, compared to known techniques, as well as more illumination of the workplaces and of the escape routes of the industrial environments, in emergency situations, thanks to a better control of the light beam, with respect to conventional devices, which allows to obtain illuminated areas of a square or rectangular shape.

It is clear that many other variations may be made to the lighting fixture of the invention, without leaving the new principles of the invention, as well as it is clear that, in the practical implementation of the invention, the materials, forms and size of the details shown may be any according to requirements and they can be replaced with other technically equivalent.

In particular, the lighting fixture of the invention can be applied to walls or ceilings, also with a light beam orientation on both the longitudinal and transverse plane; the fixture is also suitable for installation in suspended or electrified rail, thanks to the high level of illumination which can be obtained at floor even from remarkable heights.

The invention claimed is:

1. Lighting fixture (10) having a selected light distribution pattern comprising at least one LED light source (21), whose operation is ensured by a properly sized and designed electronic printed circuit board (20), and at least one housing (30) for containing said LED light source (21) and said electronic printed circuit board (20) and able to obtain a heat dissipation, wherein a lens (25, 26, 27) is placed over said LED light source (21), said lens (25, 26, 27) being selected from the group consisting of three different lenses (25, 26, 27), each of said three different lenses having different surface geometry that achieves a desired light distribution pattern said three lenses (25, 26, 27) being able to direct the light beam emitted from said LED light source (21), in order to obtain uniform illumination on surfaces to provide an illuminated area having a fixed geometry characterized in that:

a first lens (27) is placed inside a cover body (23) made of polycarbonate, with a protective film (29) placed between said cover body (23) and said printed circuit board (20), said first lens (27) being positioned in a lighting fixture (10) fixed to a ceiling at 7 meters from the floor to generate an illuminated area on the floor with a square shape, or a second lens (25) is placed inside a cover body (23) made of polycarbonate, with a protective film (29) placed between said cover body (23) and said printed circuit board (20), said second lens (25) being positioned in a lighting fixture (10) fixed to a ceiling at 3 meters from the floor to generate an illuminated area on the floor with a rectangular shape, or a third lens (26) is placed inside a cover body (23) made of polycarbonate, with a protective film (29) placed between said cover body (23) and said printed circuit board (20), said third lens (26 being positioned in a lighting fixture (10) fixed to a ceiling at three meters from the floor to generate an illuminated area on the floor with a square shape.

2. Lighting fixture (10) as claimed in claim 1, characterized in that said fixture (10) is fixed at a certain height by means of a bracket (24).

3. Lighting fixture (10) as claimed in claim 1, characterized in that said first lens (27) and said third lens (26) have equal and symmetrical sections on a plane (H, K) at 0° and on a plane at 90° and a different section on a plane (J, L) at 45°, said sections being able to identify on a plane a plurality of circle arcs, which form the geometrical shape of said first and third lenses (27, 26), with rays having different lengths at least every 15° of the section plane and with offset centers.

4. Lighting fixture (10) as claimed in claim 1, characterized in that said second lens (25) has different sections on planes (M, N, P) at 0°, at 45° and at 90°, said sections being able to identify on a plane a plurality of circle arcs, which form the geometrical shape of said second lens (25), with rays having different lengths at least every 15° of the section plane and with offset centers.

* * * * *